US006712010B2

(12) United States Patent
Bartz, Jr. et al.

(10) Patent No.: US 6,712,010 B2
(45) Date of Patent: Mar. 30, 2004

(54) METAL WORKTABLE TOP HAVING CHANNEL AND GUSSET

(75) Inventors: William L. Bartz, Jr., Dover, DE (US); Thomas A. Lewis, Dover, DE (US)

(73) Assignee: Metal Masters Foodservice Equipment Co., Inc., Clayton, DE (US)

( * ) Notice: Subject to any disclaimer, the term of this patent is extended or adjusted under 35 U.S.C. 154(b) by 0 days.

(21) Appl. No.: 10/224,763

(22) Filed: Aug. 21, 2002

(65) Prior Publication Data

US 2004/0035337 A1 Feb. 26, 2004

(51) Int. Cl.[7] ..... A47B 13/00
(52) U.S. Cl. ..... 108/157.1; 248/188
(58) Field of Search ..... 108/153.1, 156, 108/157.1, 158.11, 159; 248/188, 188.1, 188.8

(56) References Cited

U.S. PATENT DOCUMENTS 3,267,888 A * 8/1966 Carlson ..... 108/158
3,406,935 A * 10/1968 Mutchnik et al. ..... 248/188
3,530,804 A * 9/1970 Broome ..... 108/156
3,883,104 A * 5/1975 Delafield ..... 248/188
4,011,821 A * 3/1977 Neal ..... 108/156
4,925,140 A * 5/1990 Camarota ..... 248/188
5,026,010 A * 6/1991 Camarota ..... 248/188.1
5,165,349 A * 11/1992 McAllister ..... 108/156

FOREIGN PATENT DOCUMENTS

GB 2177592 * 7/1996

* cited by examiner

*Primary Examiner*—Jose V. Chen
(74) *Attorney, Agent, or Firm*—Connolly Bove Lodge & Hutz LLP

(57) ABSTRACT

The present disclosure defines a metal worktable comprising a tabletop and a plurality of table legs. The worktable has leg-supporting gussets to secure each of the table legs. Each gusset has a socket for receiving one of the table legs. Inside the socket of the gusset, there are stop protrusions that prevent the top surface of the table leg from directly contacting the underside of the tabletop. The worktable also has a inverted hat-shaped channel frame having a pair of side flanges that form the "brim" of the inverted hat shape. There are openings in the channel frame corresponding to the location of the table legs. At each opening in the channel frame, the corresponding leg-supporting gusset is recessed in the channel frame. The gusset contacts the side flanges of the channel frame rather than the underside of the tabletop. The channel frame is attached to the underside of the tabletop. Additionally, the corners of the tabletop are mitered to form a continuous lip.

10 Claims, 1 Drawing Sheet

METAL WORKTABLE TOP HAVING CHANNEL AND GUSSET

BACKGROUND OF THE INVENTION

The present invention is directed to a metal worktable comprising a tabletop and removable legs. The legs are mounted in leg-supporting gussets. The use of gussets to connect legs to a horizontally-oriented tabletop to make a worktable is well-known in the art. The gussets are often directly secured to the underside of the tabletop and the legs are simply inserted into the socket portion of each gusset to complete the assembly. For example, U.S. Pat. No. 5,165,349, which is incorporated by reference, discloses a worktable having leg-supporting gussets. The gussets described in this reference are fixed securely to an inverted hat-shaped channel frame that is in turn secured to the tabletop.

A problem with the prior art designs is that when the tabletop is subjected to forces from above, such as pounding on the tabletop with a mallet, the top surface of the table legs would contact the underside of the tabletop. Over time, this contact leads to the tabletop becoming dimpled or even cracked from the top surfaces of the table legs pushing up against the underside of the tabletop.

The prior art solution to the above problem was to use a top plate at the top of the gusset to prevent either the table leg or the top of the gusset from directly contacting the underside of the tabletop. This in turn required extra material and extra steps during fabrication.

Additionally, where worktops of the prior art had a metal lip around the perimeter of the tabletop, the corners of the tabletop required a substantial number of steps to form the corner.

The present invention provides a worktable having removable legs and mitered corners that overcomes the limitations of the prior art.

SUMMARY OF THE INVENTION

The present invention is a metal worktable comprising a tabletop and a plurality of table legs. The worktable has leg-supporting gussets to secure each of the table legs. Each gusset has a socket for receiving one of the table legs. Inside the socket of the gusset, there are stop protrusions that prevent the top surface of the table leg from directly contacting the underside of the tabletop. The worktable also has a inverted hat-shaped channel frame having a pair of side flanges that form the "brim" of the inverted hat shape. There are openings in the channel frame corresponding to the location of the table legs. At each opening in the channel frame, the corresponding leg-supporting gusset is recessed in the channel frame. The gusset contacts the side flanges of the channel frame rather than the underside of the tabletop. The channel frame is attached to the underside of the tabletop. Additionally, the corners of the tabletop are mitered to form a continuous lip In view of the above, it is an object of the present invention to provide a worktable where the table surface is not disfigured or otherwise damaged from the top surface of the table legs contacting the underside of the tabletop.

It is another object of the present invention that the mitered corners of the tabletop do not require a substantial number of fabricating and finishing steps.

Further scope of applicability of the present invention will become apparent from the following detailed description. However, it should be understood that the detailed description of the preferred embodiments of the invention is provided for illustration only. Various changes and modifications within the spirit and scope of the invention will become apparent to an ordinarily-skilled artisan from this detailed description. Therefore, it is understood that both the above general description and the following detailed description are exemplary and explanatory and do not restrict the scope of the claimed invention.

BRIEF DESCRIPTION OF THE DRAWINGS

The present invention will become more fully understood from the following detailed description and the accompanying drawing, which is only illustrative, and is not limiting of the present invention.

DETAILED DESCRIPTION OF A PREFERRED EMBODIMENT

Figure 1:
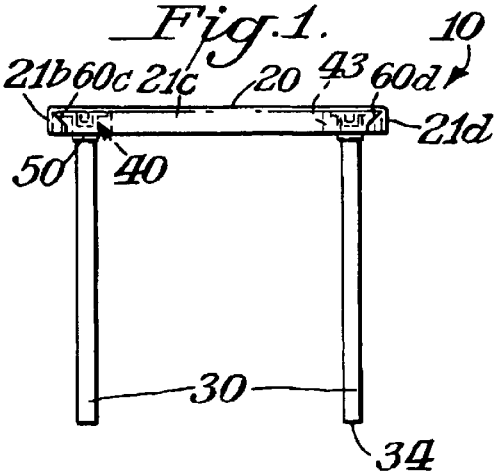
FIG. 1. A side elevational view of a work table showing leg-supporting gussets and mitered corner of the invention.

A currently preferred embodiment of the present invention is shown in FIG. 1. FIG. 1 shows the worktable 10 of the present invention comprising a tabletop 20, a plurality of table legs 30, an inverted hat-shaped channel frame 40, and leg-supporting gussets 50 that correspond to each table leg.

The table legs 30 are secured to the underside of the tabletop 20 by the recessed leg-supporting gussets 50 which are in turn fixedly secured to inverted hat-shaped channel frames 40 secured to the tabletop. The leg-supporting gusset 50 is recessed into the inverted hat-shaped channel frames 40. The table legs have both a top surface 32, which faces the tabletop 20, and a bottom surface 34 which faces the ground.

The inverted hat-shaped channel frames have opposing substantially vertical side walls 44*a* and 44*b* and a substantially horizontal bottom 46. The side walls and bottom together form a base portion 42 of the channel frame. At the top of the channel frame, that is, along the side wall opposite the bottom, there are a pair of side flanges 48*a* and 48*b* that are substantially horizontal, that is, substantially parallel to the bottom 46 and extend outwardly from the side walls 44*a* and 44*b*. The side flanges 48*a* and 48*b* can be fixed to the underside of the tabletop 20 by weld to secure the channel frame to the underside of the tabletop.

Optionally, there are a pair of opposing side plates 43 that are located on the ends 49 of the channel frame 40. These side plates 43 are oriented vertically relative to the tabletop 20 and perpendicular to the direction of the side walls 44*a* and 44*b* and bottom 46 of the channel frame 40. The side plates are welded at 70 to the tabletop sides 21*a* and 21*c*. In a preferred embodiment of the invention, the channel frames 40 are fixedly secured to the underside of the tabletop 20 by weld.

Openings 41 are provided in the base portion 42 of the channel frame at each table leg location. At each opening 41, the gusset 50 extends upwardly into the inverted hat-shaped channel frame 40 so as to be recessed into the channel frame. The gusset 50 is secured by weld 44 to the inverted hat-shaped channel frame 40. When secured, the top surface 51 of the gusset 50 is near or contacts the flanges 48*a* and 48*b* of the inverted hat-shaped channel frame. In this arrangement, the top of the gusset 50 does not directly contact the underside of the tabletop.

Figure 6:
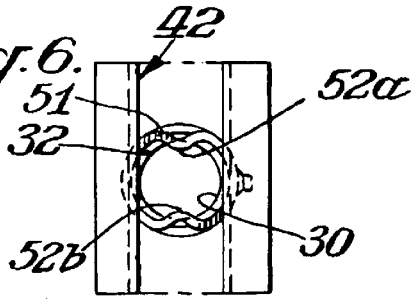
FIG. 6. Fragmental bottom view of inverted hat-shaped channel frame without the leg-supporting gusset.

In FIG. 6, the inverted hat-shaped channel frame 40 is viewed from above. In this figure, it can be seen that the gusset 50 is inserted into the corresponding opening 41 of the inverted hat-shaped channel frame. In the illustrated embodiment, the top surface 51 of the gusset 50 rests against the flanges 48*a* and 48*b*.

Figure 2:
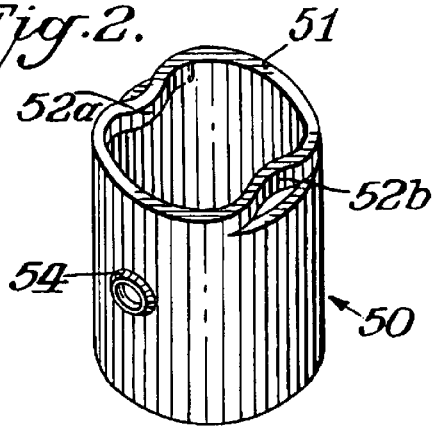
FIG. 2. Perspective view showing a leg-supporting gusset of the invention.
Figure 4:
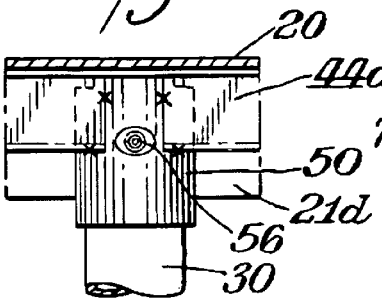
FIG. 4. Fragmental left-side elevational view of FIG. 3.

FIG. 2 shows a perspective view of the gusset 50. In FIG. 2, stop protrusions 52*a* and 52*b* of the gusset are shown. Additionally shown in FIG. 2 is a threaded hole or nut 54 located in the middle section 58 of the gusset. In FIG. 4, a set screw 56 is shown in the threaded hole 54 of the gusset. The set screw 56 is used to secure the table leg 30 that is inserted into the corresponding gusset 50.

The stop protrusions 52 of the gusset 50 are shown in FIG. 2. The stop protrusions 52 are formed by cutting the metal of the gusset and bending the metal inwards. The stop protrusions function by having the top surface of the table leg contact the stop protrusions, thereby preventing the top surface of the table leg moving deeper into the leg-supporting gusset.

In one preferred embodiment of the present invention, as shown in FIGS. 1 to 8, the table legs 30 and the corresponding leg-supporting gussets 50 are substantially cylindrical in shape. In this preferred embodiment, there are two stop protrusions 52 located opposite to one another on each leg-supporting gusset 50. Other embodiments of the invention may have more or less stop protrusions. For example, in an embodiment where the table legs 30 and the corresponding leg-supporting gussets 50 are square in shape there could be up to four stop protrusions 52 in each gusset. In such an embodiment, the stop protrusions 52 could be located on either the corners or the flat sides of the square gusset.

The table legs 30 are of sufficient size and shape such that they can be inserted into the leg-supporting gussets 50. Once inserted into the leg-supporting gussets, the table legs are secured using the set screw 56 threaded into the threaded hole or nut 54 of the leg-supporting gusset. The overall structure of the invention provides recessed leg-supporting gussets which eliminate pivot points where the table legs are connected to the tabletop. The worktable of the present invention is characterized by increased stability and resistance to flexing compared to worktables of the prior art.

Figure 3:
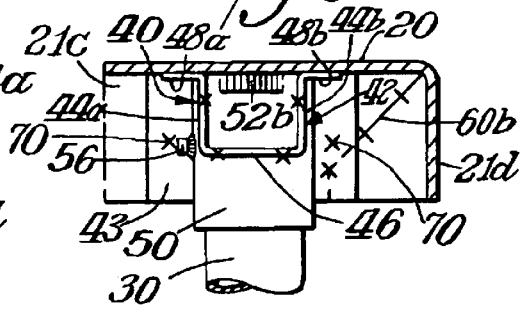
FIG. 3. A cut-away view of the work table top showing the inverted hat-shaped channel frame and leg-supporting gusset for the table legs.
Figure 7:
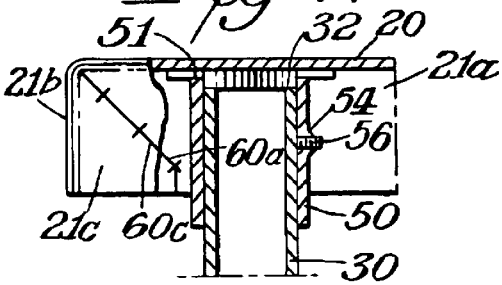
FIG. 7. Front elevational view partially in cross section of the leg-supporting gusset and table leg.
Figure 5:
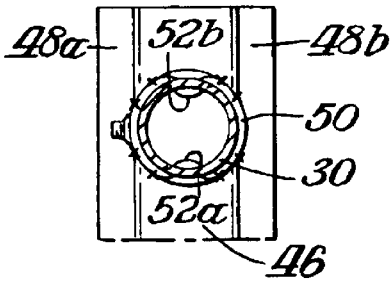
FIG. 5. Bottom plan view of FIG. 3.
Figure 8:
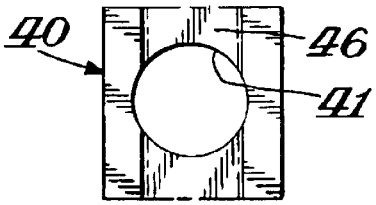
FIG. 8. Fragmental bottom view of inverted hat-shaped channel frame without gusset.

FIGS. 3 and 7 show the mitered corner 60 of the metal lip of the tabletop. The mitered corner 60*a, b, c,* and *d* is formed by cutting and removing a portion of the metal lip 22 of the tabletop 20. Before the mitered corners are fabricated, the tabletop is in the shape of a squat upside-down "U". In this form, the tabletop 20 has four sides 21*a, b, c,* and *d;* two of the sides, 21*a* and *c* have a metal lip 22 that is oriented generally vertical relative to the flat surface of the tabletop 20. The sides with the metal lip 21*a* and *c* are opposite to one another. On the remaining two sides, 21*b* and *d,* which are also opposite one another, there is no metal lip prior to fabricating the mitered corner 60*a, b, c* and *d*. By mitering a section of the metal lips 22 on the sides 21*a* and 21*c* of the tabletop, the sides of the tabletop 21*b* and *d* are bent downward to form a metal lip on the sides 21*b* and 21*d* of the tabletop. On the metal lip of sides 21*a* and 21*c*, a mitered corner is formed. The mitered corner is fixedly secured by welds. In a preferred embodiment of the invention, the tabletop has four mitered corners which allows the tabletop to have a metal lip on the perimeter of the tabletop, that is, on sides 21*a–d*.

Preferably the worktable is fabricated from metal, more preferably stainless steel. Optionally, sound deadening material may be placed between the side flanges of the inverted hat-shaped channel frames and the underside of the tabletop.

While the invention has been particularly shown and described with reference to preferred embodiments thereof, it will be understood by those skilled in the art that various changes in form and details may be made without departing from the spirit and scope of the invention as defined in the appended claims.

What is claimed is:

1. A worktable comprising (a) a tabletop;

(b) table legs, each having a top surface;

(c) an inverted hat-shaped channel frame attached to the underside of the tabletop, the channel frame having openings where the table legs are to be located; and (d) open-ended leg-supporting gussets fixedly secured to the inverted hat-shaped channel frame at each leg location, the gusset extending through the opening in the channel frame and upwardly recessed into the channel frame, each gusset having a socket for receiving a table leg;

wherein each leg-supporting gusset has inwardly extending stop protrusions engaging a table leg at the top surface thereof to thereby prevent further upward movement of the table legs in the socket of the gussets.

2. The worktable of claim 1, wherein each leg-supporting gusset has at least two stop protrusions.

3. The worktable of claim 1, wherein the table legs and leg-supporting gussets are substantially cylindrical shape.

4. The worktable of claim 1, comprising at least two inverted hat-shaped channel frames, each channel frame comprising at least two leg-supporting gussets.

5. The worktable of claim 4, wherein the at least two channel frames are fixed to the tabletop by weld.

6. The worktable of claim 4, wherein each of the at least two channel frames further comprise opposing side plates.

7. The worktable of claim 6, wherein the opposing side plates are fixed to the tabletop by weld.

8. The worktable of claim 1, wherein the channel frame comprises a pair of side flanges, a pair of side walls, and a bottom.

9. The worktable of claim 8, wherein the leg-supporting gusset contacts the pair of side flanges of the channel frame.

10. The worktable of claim 1 further comprising at least two mitered corners.

* * * * *